US006039017A

United States Patent [19]

Hendriksma

[11] Patent Number: 6,039,017

[45] **Date of Patent: *Mar. 21, 2000**

[54] HYDRAULIC LASH ADJUSTER WITH LASH

[75] Inventor: Nick John Hendriksma, Grand Rapids, Mich.

[73] Assignee: General Motors Corporation, Detroit, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/251,024

[22] Filed: Feb. 18, 1999

[51] Int. Cl.[7] ..... F01L 1/24

[52] U.S. Cl. ..... 123/90.43; 123/90.19; 123/90.36; 123/90.55

[58] Field of Search ..... 123/90.19, 90.35, 123/90.36, 90.39, 90.41, 90.43, 90.46, 90.48, 90.49, 90.55

[56] References Cited

U.S. PATENT DOCUMENTS 2,937,632 5/1960 Voorhies ..... 123/90.36
3,542,001 11/1970 Line ..... 123/90.43

*Primary Examiner*—Wellun Lo
*Attorney, Agent, or Firm*—Vincent A. Cichosz

[57] ABSTRACT

A hydraulic lash adjuster having a piston capable of forming a pivot for a member of an engine valve train connecting a cam and a valve includes a hydraulic lash adjusting element of varying length for acting in the valve train, an expansion spring for extending the length of the lash adjuster to take up lash in the valve train between valve opening events and a lash spring which biases the adjuster element away from the piston a small amount to maintain a sufficient amount of lash in the valve train between valve opening events to prevent holding open of the valve during cold engine operation. Various embodiments of lash adjusters and lash springs are disclosed. During steady state operation, the lash spring introduces a fixed amount of mechanical lash into the valve train. In nonsteady state transient operations, such as during cold engine start up, the amount of mechanical lash may be reduced when growth of the valve train components exceeds the leak down rate of the hydraulic lash adjusting element. However, as long as the amount of mechanical lash is adequate to offset the excessive growth of the valve train components, opening of the valve due to thermal pump up is prevented. As the engine warms up and a normal leak-down rate of the hydraulic lash adjusting element is reached, operation with a fixed amount of mechanical lash returns.

4 Claims, 6 Drawing Sheets

HYDRAULIC LASH ADJUSTER WITH LASH

TECHNICAL FIELD

This invention relates to hydraulic lash adjusters for taking up lash in the valve trains of engines and, more particularly, to lash adjusters that form pivots for finger cam followers and which retain a small amount of valve lash in the valve train to prevent thermal pump up of the lash adjusters from holding open the valves during cold engine operation after start up.

BACKGROUND OF THE INVENTION

A hydraulic lash adjuster, of the type capable of forming a pivot for a cam actuated finger follower in an engine valve train, commonly consists of two major elements, a body and a plunger. The body is a cup-shaped or cylindrical member having a peripheral outer wall with closed and open ends, and is mountable directly in a cylinder head or other camshaft mounting member of an engine. The plunger has the general form of a hollow piston with a rounded top, which acts as a pivot for an associated finger follower.

The plunger is reciprocably received within the body with close clearance for controlling the leakage of oil between the adjoining surfaces. An inner end of the plunger includes means defining a wall with a check valve controlled orifice leading from an oil reservoir within the plunger to an enclosed space between the lower plunger wall and the closed end of the body which forms a high pressure chamber. The oil reservoir is supplied from the engine through openings in the walls of the body and plunger, and an opening in the rounded outer end supplies oil to lubricate the finger follower and associated components.

In operation, when the associated engine valve is closed and the finger follower engages the cam on its base circle, a plunger spring in the high pressure chamber forces the plunger outward to take up lash between the plunger and finger follower, and thus remove all lash from the valve train. This lowers the pressure in the high pressure chamber so that oil is drawn from the reservoir in the plunger through the check valved orifice into the high pressure chamber which is maintained full of oil. During the next valve opening cycle, the reaction force from the engine valve spring acts downwardly against the plunger, increasing pressure in the high pressure chamber and forcing some of the oil therein out of the high pressure chamber through clearances between the plunger and body. During operation at normal engine temperatures, this oil is replaced by makeup oil from the plunger reservoir when the valve is closed on the next phase of its operating cycle.

During start up of a cold engine, oil viscosity is high and exhaust valve growth is rapid so that hydraulic lash adjusters which use a spring biased plunger may not provide a sufficient leakdown rate to avoid holding the valve off its seat on the cam base circle, a condition sometimes called thermal pump up. This condition may cause improper engine operation or stalling and thus requires correction.

Mechanically lashed valve trains provide sufficient lash to accommodate transient growth of valve train components following start up. However, they do not have the capability of automatically compensating for build tolerances and wear over the life of the engine as hydraulic lifters do. Means for correcting the thermal pump up problem while retaining the benefits of hydraulic lash adjusters are accordingly desired.

SUMMARY OF THE INVENTION

The present invention provides a solution to the cold start thermal pump up problem by adding a sufficient amount of built-in lash to a hydraulic lash adjuster to prevent thermal pump up of the exhaust valves while maintaining the automatic lash compensation function of the hydraulic lash adjuster. In general, this is accomplished by separating the traditional plunger into two components, a lower component called the plunger and including the orificed wall that defines with the body a high pressure chamber, and an upper component called a piston, formed with a curved outer end that provides a pivot for the finger follower and having a hollow interior in which oil is received for feeding the high pressure chamber and lubricating the finger follower.

A lash spring is provided which, by itself or with other elements, holds an open end of the plunger a small distance, called the lash offset, away from a corresponding open end of the piston to provide a predetermined amount of mechanical lash in the lash adjuster and therefore in the engine valve train. The lash provided is greater than the amount of thermal pump up that will be experienced in operation of the engine under all operating conditions, and therefore prevents thermal pump up of the exhaust valves from interfering with the proper operation of the associated engine.

In certain embodiments, the plunger is guided in the body and the lash spring is made stronger, that is provides a greater force, than the plunger spring, so that the lash spring holds the plunger and piston apart until the associated valve is opened and the lash is taken up.

In alternative embodiments, the plunger is guided within an extension of the piston which the plunger spring directly actuates through a stop. The stop also limits travel of the plunger within the piston. Thus, the lash spring acts only to hold the plunger away from an open end or abutment of the plunger to provide the desired lash, which is taken up upon opening of the valve. In these embodiments, the plunger spring is made stronger than the lash spring so as to maintain the travel limit established for the plunger.

DESCRIPTION OF THE PREFERRED EMBODIMENT

Figure 1:
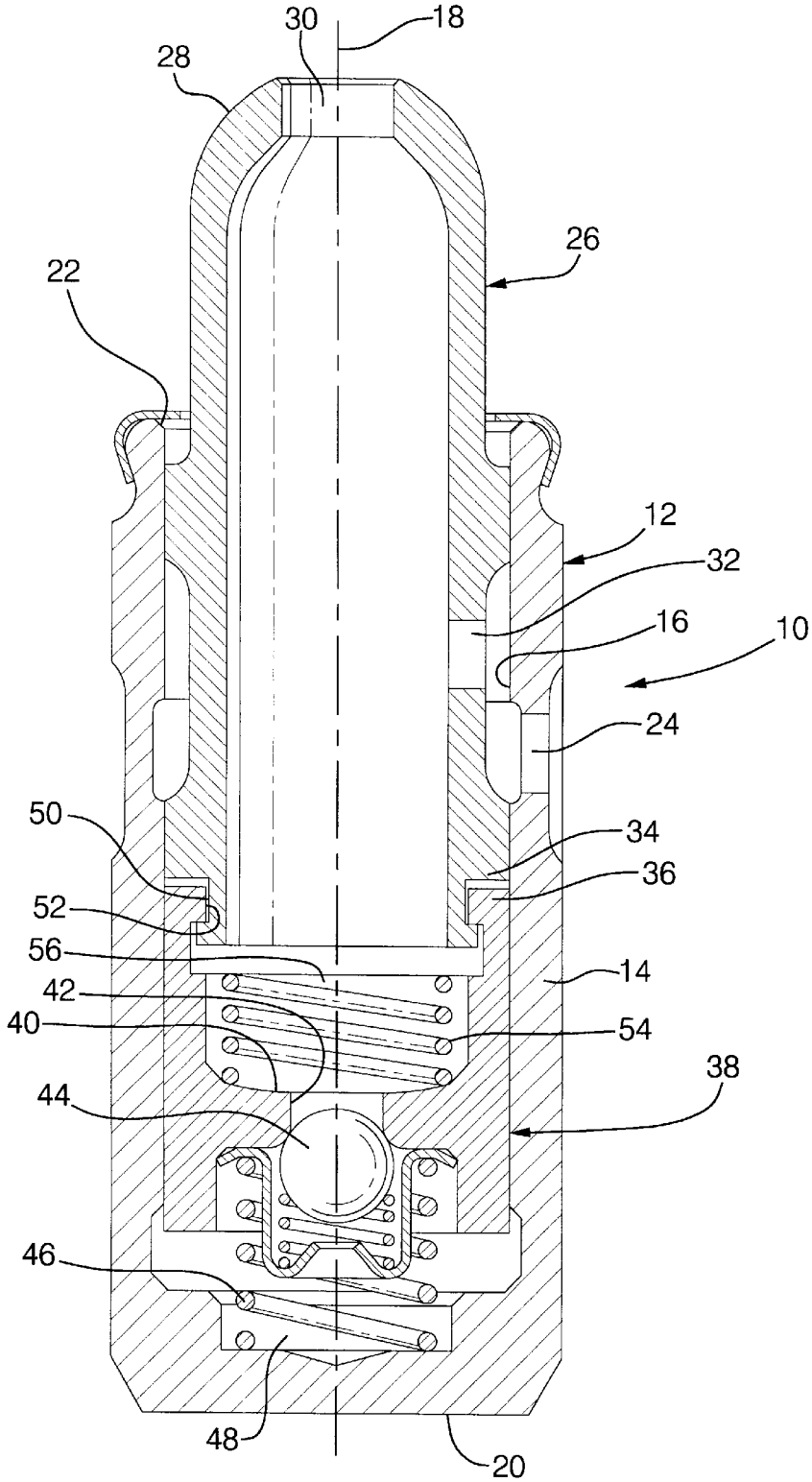
FIG. 1 is a cross-sectional view of a first embodiment of hydraulic lash adjuster according to the invention.

Referring now to the drawings in detail, numeral 10 generally indicates a hydraulic lash adjuster (HLA) formed in accordance a first exemplary embodiment of the invention. Lash adjuster 10 includes a cup-shaped or cylindrical body 12 having a peripheral outer wall 14 defining an internal cylinder 16 centered on an axis 18. The body 12 also includes a closed end 20 and an open end 22. An oil feed opening 24 is provided in the peripheral wall of the body 12.

A hollow piston 26 is reciprocably received within the body 12 and includes a curved or rounded outer end 28 extending out through the open end of the cylinder 16 and having a central oil discharge opening 30. The rounded outer end 28 is provided to form a pivot for an associated finger follower in the valve train of an engine, not shown. An oil inlet opening 32 in a side of the piston 26 communicates through cooperating annular recesses around the piston and in the cylinder with the opening 24 to provide for the passage of lubricating oil from the associated engine through the openings 24, 32, into the hollow interior of the piston 26.

Piston 26 also has an open inner end 34 that is engagable with an open end 36 of a plunger 38, which is reciprocably movable within the cylinder 16 along the cylinder axis 18. The plunger 38 includes a lower wall 40, including a central feed orifice 42 that is normally closed by a spring biased ball check valve 44 held against the wall 40 by a plunger spring 46. The plunger spring 46 is disposed within a high pressure chamber 48 formed between the closed end 20 of the cylinder 16 or body 12, and the lower end wall 40 of the plunger.

The open ends 34, 36 of the piston and plunger are formed with interlocking axial-motion limiting means. These include an outwardly opening groove 50 in a recessed exterior portion of the piston, and an inwardly extending flange 52 in a co-acting portion of the open end of the plunger. The groove 50 has an axial width slightly greater than the width of the flange 52, leaving a clearance, called the lash offset, which provides for a small amount of relative movement between the plunger and piston for a purpose to be subsequently described.

A coil type compression spring or lash spring 54 extends from the wall 40 of the plunger 38, through the hollow central portion of the plunger which forms a low pressure chamber and into engagement with the lower open end of the piston 26, biasing the plunger and piston apart to maintain the lash offset distance between the adjoining ends of the plunger and piston under the valve closed condition shown in FIG. 1.

In operation in the valve train, not shown, of an associated engine, oil supplied to the interior of the piston 26 fills the low pressure chamber 56 of the plunger and is forced through the check valve controlled orifice 42 into the high pressure chamber 48, which is normally filled with oil at engine oil pressure. When the associated engine valve, not shown, is opened, a downward force on the piston 26 first compresses the lash spring 54, closing the clearance or lash offset and causing the open ends of the piston and plunger to be forced into solid engagement. Thereafter, the finger follower loads the piston 26 downwardly, increasing the oil pressure in the high pressure chamber 48. The ball check valve 44 closes the orifice 42 to prevent the escape of oil through the orifice and the compressed oil supports the plunger 38 and piston 26 to provide the needed reaction pivot required for opening of the associated valve.

During the valve opening event, the pressure in the high pressure chamber is significantly increased in order to support the load imposed by the valve train. Since oil cannot escape from the high pressure chamber through the orifice 42, which is blocked by the check valve 44, a certain amount of oil is forced through the radial clearance between the plunger and the cylinder 16 up to the inlet opening 24 and the associated recesses where it recirculates into the hollow piston 26. This causes a small reduction in the volume of the high pressure chamber 48 which is limited by the close clearance between the plunger and cylinder, but is necessary for the proper operation of the lash adjuster 10.

When the valve is again closed, the opening valve spring reaction load is removed. The plunger spring 46 then forces the plunger and piston upwardly, causing the pressure in the high pressure chamber 48 to be reduced and allowing makeup oil to flow from the low pressure chamber 56, and the interior or reservoir in the hollow piston, into the high pressure chamber to make up for the oil lost during the previous valve opening event. This continues during operation of the finger follower on the base circle of the associated cam until all of the lash created in the valve train by the escape of oil from the high pressure chamber is taken up.

Note that the lash spring 54 is stronger, that is exerts a greater force, than the plunger spring 46, so that the lash spring again separates the plunger and piston, reinstating the mechanical lash offset clearance previously referred to. The plunger spring forces the plunger upwardly as far as it can but is prevented from closing the lash offset clearance by the stronger lash spring forcing the plunger downward. Thus, when the cam again reaches the point of opening of the associated valve, the mechanical lash offset is again closed first before contact of the piston with the plunger occurs and the combination becomes a solid pivot for opening the valve against the force of the still stronger valve spring, not shown.

When the engine is being started, or operated under extremely cold conditions, the situation may occur where the relatively quick heating of the exhaust valves causes rapid growth in the reaction length of the valve train which exceeds the ability of the highly viscous cold oil to leak out from the high pressure chamber 48 through the clearances around the plunger 38 during the time when the valve is held open. In this case, there would be negative lash in the system except for the initial lash offset which is made large enough to accommodate any anticipated thermal pump up of the valve train as a result of the rapid thermal growth of the valves. Thus, the lash offset will be reduced as long as the growth of the exhaust valves exceeds the leakage rate of oil from the lash adjuster. However, this condition will be reversed by warming of the oil which allows the leakage to increase until normal conditions return and the lifter is again allowed to shorten a sufficient amount during the valve open periods to offset the growth which occurred in the length of the valve train during the warmup period. Thus, the valve will never be held open by thermal pump up, or retention of oil in the lash adjuster which exceeds the rate of growth of the associated exhaust valve and the associated portions of the valve train.

Figure 2:
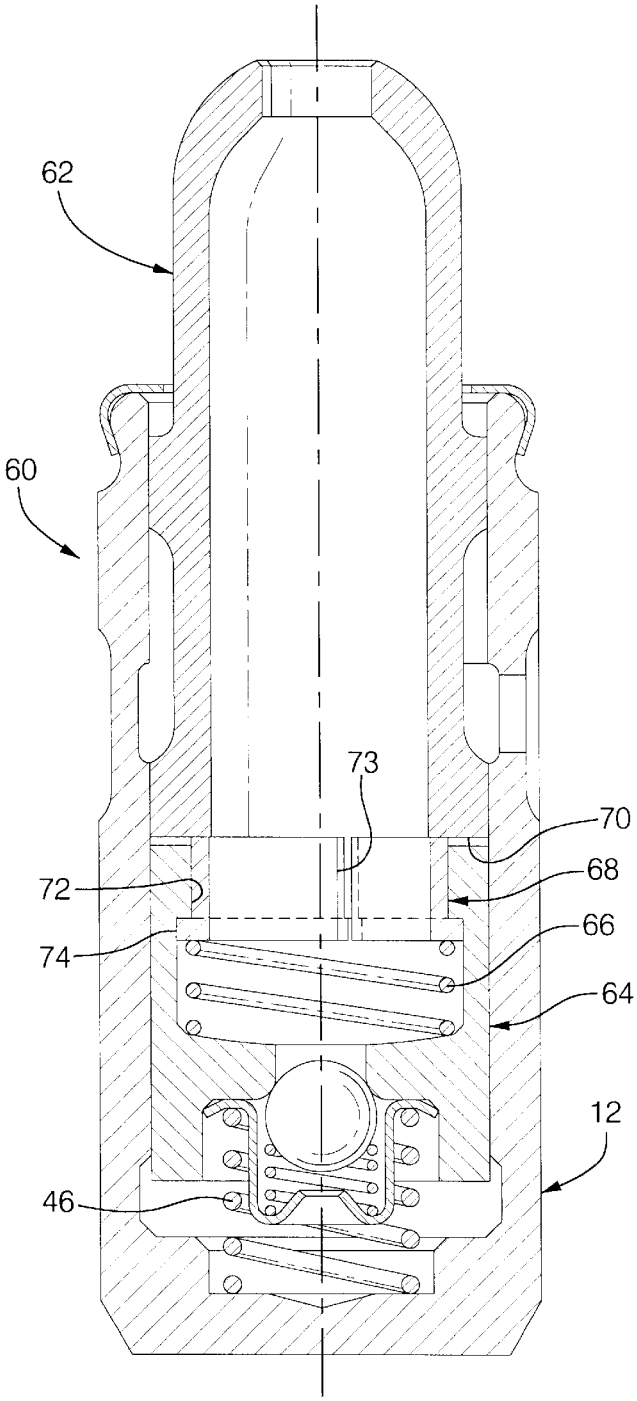
FIG. 2 is a cross-sectional view similar to FIG. 1 and showing a second embodiment of hydraulic lash adjuster according to the invention.
Figure 3:
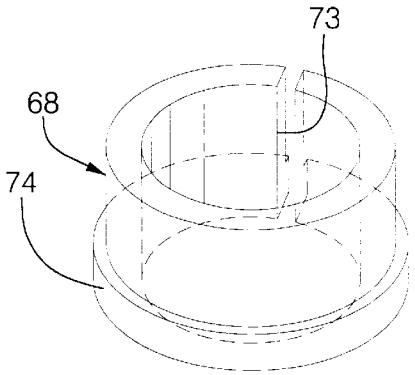
FIG. 3 is a pictorial view of the lash sleeve used in the embodiment of FIG. 2.

Referring now to FIGS. 2 and 3, numeral 60 generally indicates a second embodiment of hydraulic lash adjuster according to the invention. Lash adjuster 60 is generally similar to the embodiment of FIG. 1, so that like numerals are used to indicate like parts. The second embodiment 60 differs from the first, in the provision of a modified piston 62, plunger 64, and lash spring 66, and the addition of a lash sleeve 68. In this embodiment, the piston 62 is machined square at its inner end 70 and the annular flange 72 of the plunger 64 is made longer to guide the body of the added lash sleeve 68.

The lash sleeve 68 is split at 73 and includes an outwardly extending flange 74 on its inner end. The split allows installation of the lash sleeve within the low pressure chamber in the plunger by compressing the split ring until its flange 74 slides within the annular flange 72 of the plunger. The flange is then positioned so that the flanges 72, 74 engage one another, locking the lash sleeve 68 in place within the plunger 64, with a small length of the lash sleeve extending out of the plunger to create the lash offset. The shortened lash spring 66 extends between the plunger 64 and the inner end of the lash sleeve to bias the lash sleeve against the plunger flange 72.

As in the first embodiment, the lash spring 66 of FIG. 2 is made stronger than the plunger spring 46 so that the lash spring will maintain a lash offset by biasing plunger 64 away from the piston 62 under all conditions except during each valve opening event. Operation of the second embodiment is, thus, essentially the same as that of the first embodiment, differing only in that the lash spring 66 biases the plunger away from the piston indirectly through engagement with the lash sleeve which, in turn, engages the piston 62.

Figure 4:
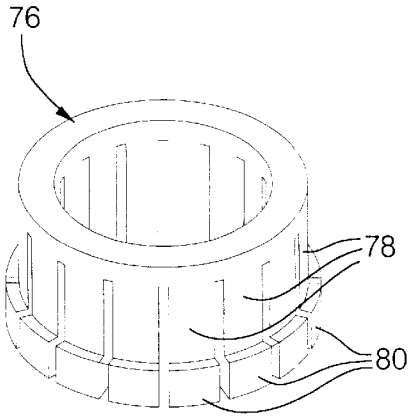
FIG. 4 is a pictorial view of an alternate design of lash sleeve or use in the embodiment of FIG. 2.

FIG. 4 illustrates an alternative design of lash sleeve 76 which could be used in hydraulic lash adjuster 60 in place of sleeve 68, previously described. The lash sleeve 76 is a solid ring but has its inner end slotted to provide a plurality of axially extending fingers 78 having outwardly extending portions 80 which act as an interrupted flange that functions in the same manner as the flange 74 of the split ring lash sleeve 68. Installation of sleeve 76 in the plunger 64 is accomplished by springing the fingers 78 inwardly so that the outwardly extending portions may pass inside the flange 72 and snap into place behind it for operation, as described.

Figure 5:
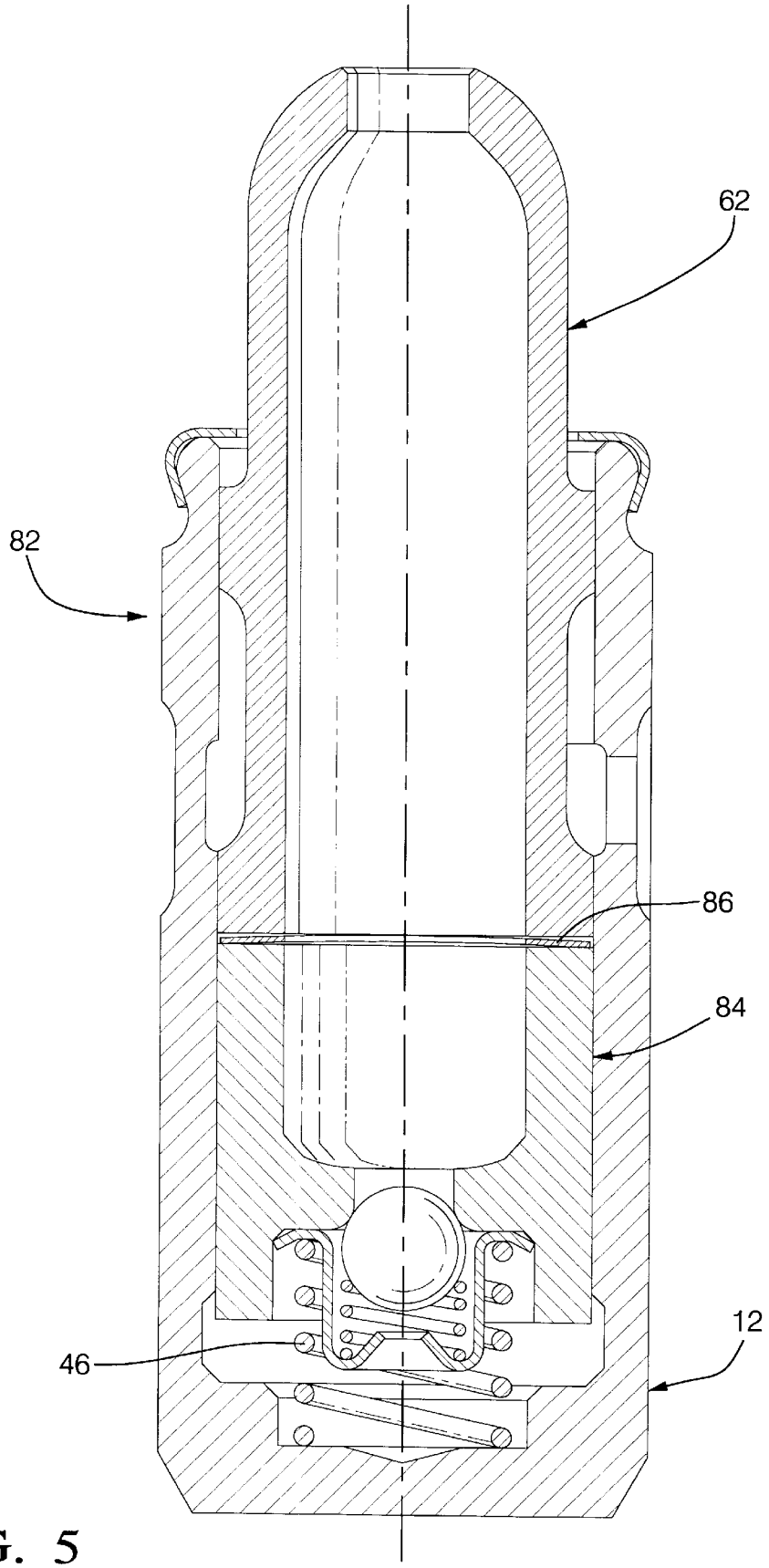
FIG. 5 is a cross-sectional view of a third embodiment of hydraulic lash adjuster according to the invention.
Figure 6:
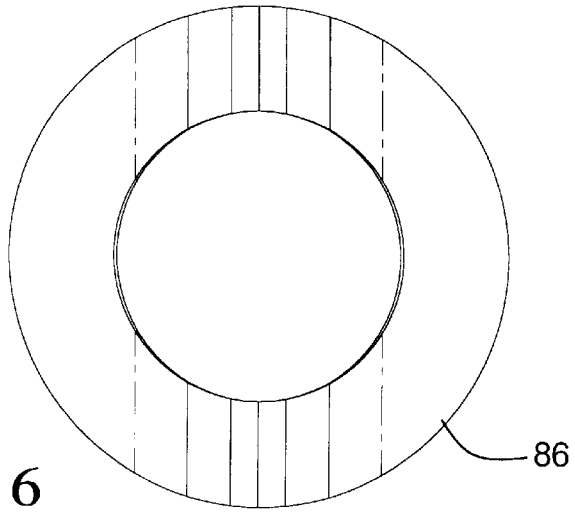
FIGS. 6 and 7 are, respectively, plan and edge views of a curved washer lash spring for use in the embodiment of FIG. 5.
Figure 7:
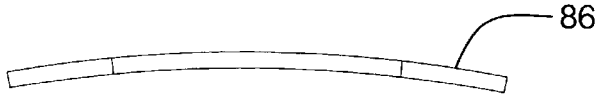

Referring now to FIG. 5, there is shown a third embodiment of hydraulic lash adjuster 82 according to the invention. Again, most of the components of lash adjuster 82 are similar to components of the embodiments previously described, so that like numerals indicate like parts. The differences in construction lie in modified plunger 84 and the form of lash spring 86. In particular, the plunger 84 has its outer end machined square for direct operative engagement with the squared off end of the piston 62. However, between the opposed ends of the piston and the plunger, there is disposed a washer-like lash spring 86 having the form of the curved washer lash spring shown in FIGS. 6 and 7. Lash spring 86 is, again, stronger than the plunger spring 46 so that it biases the plunger downward a small amount to create a lash offset equal to the spacing between the opposed ends of the plunger and piston, minus the thickness of the curved washer lash spring.

Unlike the first two embodiments in which the lash spring is preloaded in assembly and the amount of lash offset is controlled by the dimensions of the interengaging plunger, piston and lash sleeve elements, the lash offset in the embodiment of FIG. 5 is subject to some variation and is controlled only by careful control of the specifications of the lash spring 86 itself.

Operation of the embodiment of FIG. 5 is functionally similar to those previously described in that the lash spring 86 maintains a lash offset under all conditions except when the associated engine valve is opened. Then, the opening force of the cam first closes the lash offset by compressing the cured washer spring until it is flat. Thereafter, the valve is opened and the cycle is completed in the same manner as previously described.

Figure 8:
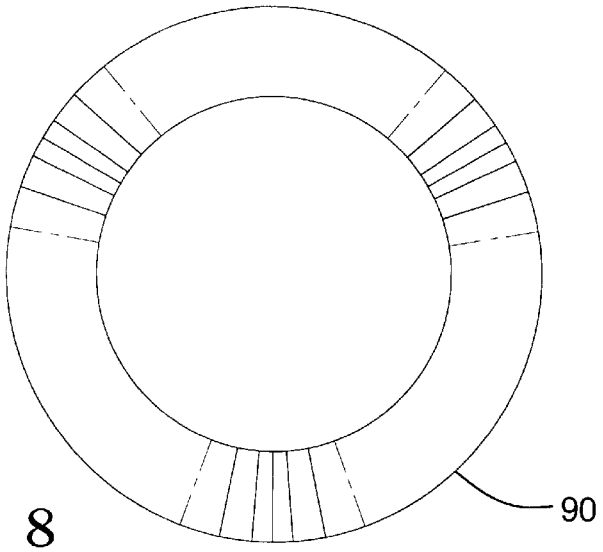
FIGS. 8 and 9 are, respectively, plan and edge views of a wave washer lash spring for use in the embodiment of FIG. 5.
Figure 9:
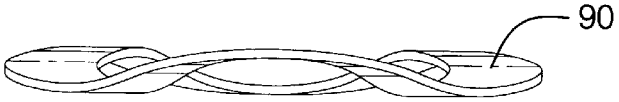
Figure 10:
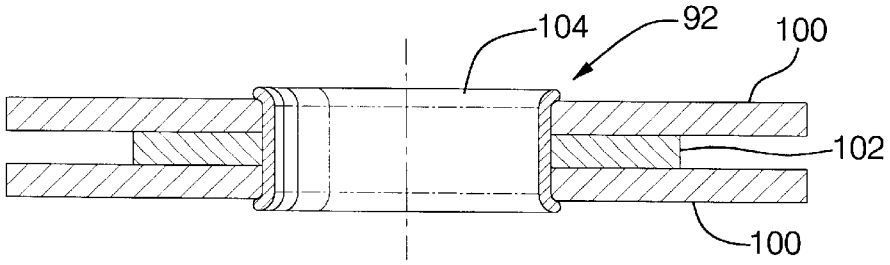
FIGS. 10–13 are cross-sectional views illustrating four alternative embodiments of sandwich washer springs for use in embodiments similar to that of FIG. 5.

FIGS. 8 and 9 disclose an alternative embodiment of lash spring which is in the form of a wave washer or wave spring 90. Lash spring 90 has a circular periphery that is undulating in a circumferential direction to provide the necessary force to hold the plunger and piston of an associated lash adjuster apart to form the lash offset. As before, opening of an associated valve causes the piston to flatten the lash spring 90 against the plunger, closing the lash offset prior to opening of the valve.

FIGS. 10 through 13 disclose four different types of lash springs 92, 94, 96 and 98, respectively, which are herein referred to as sandwich type springs. Spring 92 constitutes a sandwich of two flat spring washers 100 separated by a smaller diameter support washer 102, all held together by a center sleeve 104. Lash spring 92 may be substituted for lash spring 86 in the embodiment of FIG. 5 with any necessary adjustment of the dimensions of the plunger and piston. Upon installation, the annular spring washers 100 are side-loaded at their outer peripheries by engagement with the piston and plunger. Upon opening of the associated engine valve, the outer edges of washers 100 are forced together to close the lash offset and operate in the same manner as previously described for the other embodiments.

Figure 11:
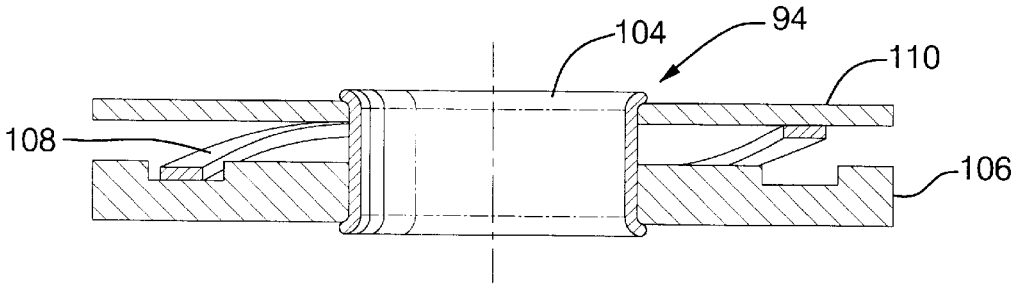

Lash spring 94, shown in FIG. 11, constitutes a grooved support washer 106 supporting a wave spring washer 108 which is preloaded by an upper washer 110, all held together by a sleeve 104. In use, the lash spring 94 is placed between opposing ends of the plunger and piston and, upon opening of the associated engine valve, the upper washer 110 is forced downward against the support washer 106, flattening the wave spring washer 108 to close the lash offset and allow opening of the valve.

Figure 12:
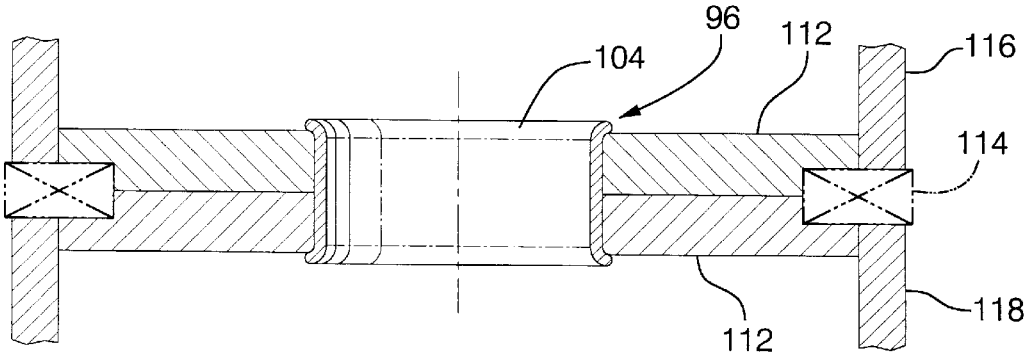

Lash spring 96, shown in FIG. 12, defines a different form of preloaded lash spring, including upper and lower retainer washers 112 held together by a sleeve 104 and having peripheral cutouts defining a groove in which a spring 114 of any suitable type, such as a curved washer spring or wave washer spring, may be installed. The spring 114 extends radially beyond the retainer washers 112 and is located with its periphery between the opposing ends 116, 118, of an associated piston and plunger, respectively. In this embodiment, the plunger and piston act directly upon the spring 114 while the retainer washers 112 merely hold the spring 114 in position, preloaded to a desired initial force for action against the plunger spring.

Figure 13:
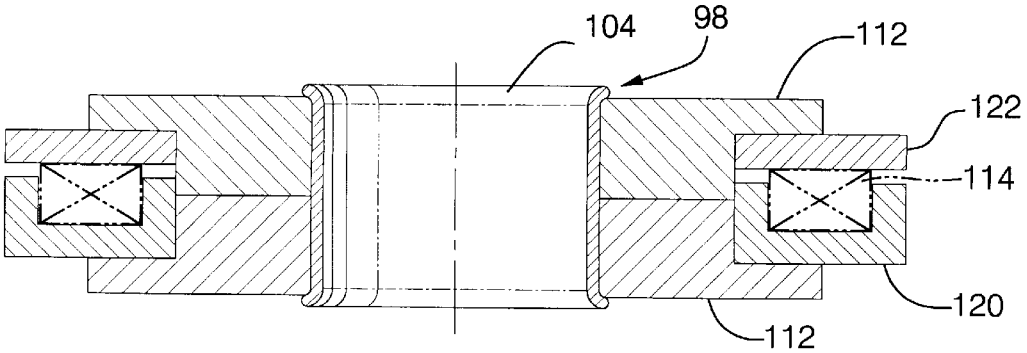

Lash spring 98, shown in FIG. 13, is somewhat similar to that of FIG. 12 in that it includes a pair of retainer washers 112 connected by a sleeve 104 and defining a peripheral groove. However, it differs in having in the groove an annular retainer 120 having a U-shaped, or other, cross section, and a flat retainer 122, which together contain a suitable washer type spring 114, similar to that of the spring of FIG. 12. In this embodiment, the annular U-shaped and flat retainers 120, 122, are spaced apart to determine the lash offset and are engaged directly by the ends 116, 118, not shown in this view, of the piston and plunger, respectively, so as to accomplish operation in the same manner as the embodiments previously described.

Figure 14:
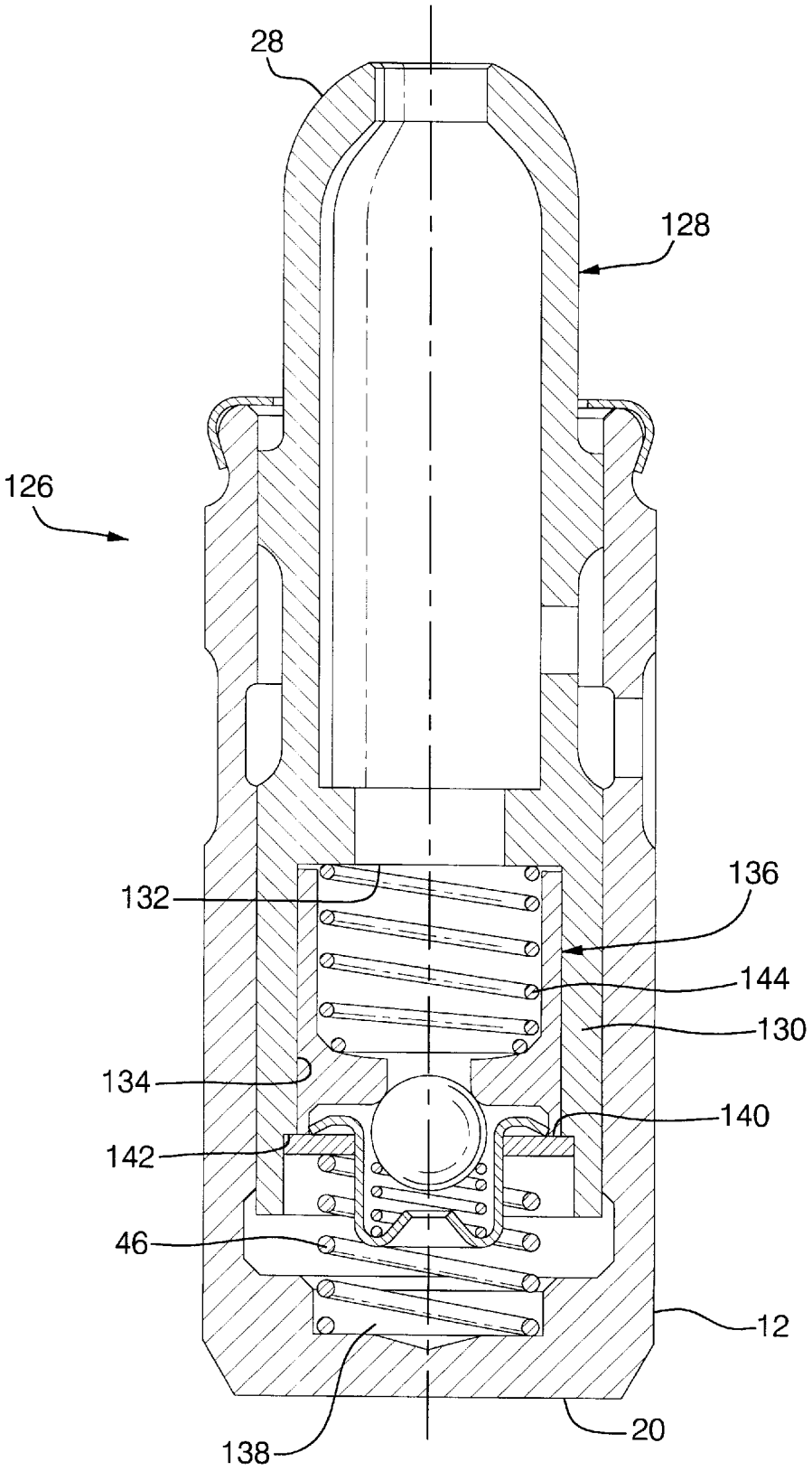
FIG. 14 is a cross-sectional view of a fourth alternative embodiment of hydraulic lash adjuster according to the invention.

Referring now to FIG. 14 of the drawings, there is shown a fourth embodiment of hydraulic lash adjuster 126 having a somewhat different form of construction and operation than the embodiments previously described. Adjuster 126 includes a body 12 like those of the previous embodiments. However, the piston 128, which is reciprocable in the body 12 and has a curved end 28 forming a pivot, also includes a cylindrical extension 130 downward from the operative open end 132 of the piston. Extension 130 internally defines a cylinder 134 in which a plunger 136 is reciprocably carried instead of directly engaging the body as in the previous embodiments. Below the plunger 136 and piston 128, a plunger spring 46 is disposed within a high pressure chamber 138. The plunger spring extends between the closed end 20 of the cylinder 12 and an annular stop washer 140. The washer 140 engages both an abutment 142 near the lower end of the cylindrical extension 130 of the piston and a lower end of the plunger 136. Thus, the stop washer 140 urges both the piston 128 and plunger 136 upwardly under the bias of a plunger spring 46 to take up lash in the valve train when the follower is operating on the base circle of the associated cam, not shown. The lash offset is positively provided by forming the length of the cylinder 134 between the stop washer 140 and the operative open end 132 of the piston with a slightly longer length than the length of the plunger which is reciprocably disposed within the cylinder 134. The difference in lengths is equal to the lash offset and proportional to the amount of reciprocating motion of the piston relative to the body which may occur in operation of the engine.

In this embodiment, a lash spring 144 acts between the interior of the plunger and the operative open end 132 of the piston as before. However, the lash spring 144 must be made weaker than the plunger spring 46 in order to prevent the lash spring from pushing the plunger downward where such action is not desired, since it has no function in this embodiment in determining the amount of lash offset.

Thus, in operation of the fourth embodiment of FIG. 14, the lash spring maintains the lash offset open as long as the follower is operating on the base circle of the associated cam. When the cam begins to open the valve, the piston is first forced down until the lash offset dimension between the open ends of the plunger and piston is closed. Thereafter, compressed oil in the high pressure chamber 138 acts on the lower end of the plunger to hold the piston in place so that it may act as a pivot for the associated finger follower and allow opening of the valve in the manner previously described. In other ways, the operation and construction of this fourth embodiment is essentially the same as those previously described.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

I claim:

1. A hydraulic lash adjuster capable of forming a pivot for a member of an engine valve train connecting a cam and a valve, said adjuster comprising:

a cup-shaped body with a peripheral outer wall defining an internal first cylinder formed around an axis and having closed and open ends;

a hollow piston reciprocable in the cylinder and extending out through the open end of the body, the piston having a rounded outer end for acting as a pivot and an open inner end having an inward extension defining a second cylinder spaced from the closed end of the first cylinder;

hydraulic means in the body including a plunger reciprocable within the second cylinder and having an open outer end operatively engagable with the open end of the piston for holding the piston outward during valve actuation, the plunger defining a low pressure chamber for receiving hydraulic fluid supplied from the engine, the plunger being spaced from the closed end of the first cylinder and defining therewith a high pressure chamber connected through a non-return check valve with the low pressure chamber for delivering fluid to the high pressure chamber, a take up spring acting between the closed end of the first cylinder and the piston and urging the piston outward from the first cylinder to take up lash in the associated valve train; and a lash spring disposed between the plunger and the piston, the lash spring biasing the plunger a small distance away from the open end of the piston when the associated valve is closed to provide selected lash in the lash adjuster to prevent compressed fluid in the high pressure chamber from holding the valve open during cold engine operation.

2. A hydraulic lash adjuster as in claim 1 wherein said lash spring urges the plunger against a stop associated with the piston to provide said selected lash when the associated valve is closed, said take up spring being stronger than the lash spring to take up lash in the valve train other than the lash provided by the lash spring.

3. A hydraulic lash adjuster as in claim 2 wherein said stop is a washer engaged by the take up spring and engaging independently both the plunger and the piston.

4. A hydraulic lash adjuster as in claim 2 wherein said lash spring is a coil spring disposed in the low pressure chamber defined by the plunger.

* * * * *